US010941031B2

(12) United States Patent
Jung et al.

(10) Patent No.: US 10,941,031 B2
(45) Date of Patent: Mar. 9, 2021

(54) WATER PURIFIER AND CONTROL METHOD OF A WATER PURIFIER

(71) Applicant: LG ELECTRONICS INC., Seoul (KR)

(72) Inventors: Soonki Jung, Seoul (KR); Minho Kim, Seoul (KR); Hoon Jang, Seoul (KR); Jingyu Ji, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/670,343

(22) Filed: Oct. 31, 2019

(65) Prior Publication Data

US 2020/0156920 A1 May 21, 2020

(30) Foreign Application Priority Data

Nov. 19, 2018 (KR) ..... 10-2018-0142749

(51) Int. Cl.
*B67D 1/08* (2006.01)
*B67D 1/00* (2006.01)

(52) U.S. Cl.
CPC ..... *B67D 1/0882* (2013.01); *B67D 1/0009* (2013.01); *B67D 1/0081* (2013.01); *B67D 2210/00039* (2013.01)

(58) Field of Classification Search
CPC ..... B67D 1/00082; B67D 1/0009; B67D 1/0081; B67D 2210/00039; B67D 1/0859; B67D 1/0006; B67D 1/0888; B67D 1/0014; B67D 1/0085; B67D 2210/00031; B67D 2210/00041; B67D 2210/0001; B67D 1/08
See application file for complete search history.

(56) References Cited

U.S. PATENT DOCUMENTS

| | | | | |
|---|---|---|---|---|
| 10,343,888 | B2 * | 7/2019 | Jeon | A47J 31/4482 |
| 2017/0050836 | A1 | 2/2017 | Yoon | |
| 2018/0194608 | A1 | 7/2018 | Jeon et al. | |

FOREIGN PATENT DOCUMENTS

| | | |
|---|---|---|
| KR | 10-2010-0054580 | 5/2010 |
| KR | 10-2010-0111852 | 10/2010 |
| KR | 10-2012-0087370 | 8/2012 |
| KR | 10-1381803 | 4/2014 |
| KR | 10-1818390 | 1/2018 |
| KR | 10-2018-0082963 | 7/2018 |
| WO | WO 2017/034145 | 3/2017 |

OTHER PUBLICATIONS

Korean Notice of Allowance dated Mar. 26, 2020 issued in KR Application No. 10-2018-0142749.
European Search Report dated Mar. 27, 2020 issued in EP Application No. 19210114.5.

* cited by examiner

*Primary Examiner* — Craig M Schneider
*Assistant Examiner* — Jason K Niesz
(74) *Attorney, Agent, or Firm* — Ked & Associates, LLP

(57) ABSTRACT

A liquid dispenser includes a first lifting cover, a second lifting cover, a lifting motor, a gear module, and a dispenser nozzle. The first lifting cover includes a lifting gear extending in a vertical direction. The gear module includes a gear bracket coupled to the second lifting cover and a gear. The gear is rotated along the lifting gear by the operation of the lifting motor, and the second lifting cover is relatively moved with respect to the first lifting cover in the vertical direction.

25 Claims, 12 Drawing Sheets

WATER PURIFIER AND CONTROL METHOD OF A WATER PURIFIER

CROSS-REFERENCE TO RELATED APPLICATION

This application claims priority under 35 U.S.C. § 119 to Korean Application No. 10-2018-0142749 filed on Nov. 19, 2018, whose entire disclosure is hereby incorporated by reference.

BACKGROUND

1. Field

A water purifier and a control method of a water purifier are disclosed herein.

2. Background

A water purifier may be a device for filtering water to supply purified water from which impurities have been removed. The water purifier is widely used throughout household appliances or industries. In particular, the water purifier may be provided as a domestic water purifier which provides a user-consumable water purifier.

The water purifier may include a water purifier main body on which a filter or the like is mounted and a water outflow part which provides water filtered at the water purifier main body. The water outflow part may be fixedly disposed on a front surface of the water purifier main body. Accordingly, the user can place a container or the like, which receives water, in the water outflow part to receive purified water.

With such a structure, since the user may be restrained by the position of the water outflow part, there is a problem that the user's convenience cannot be secured. In order to solve such a problem, the related art 1 as follows has been registered and published.

1. Registration number: No. 10-1381803 (Publication date: Apr. 7, 2014) 2. Title of invention: Water purifier.

In the above-related art 1, a water outflow part is provided on one side of the main body, and the water outflow part may be rotated to a predetermined angle in the main body and coupled. In particular, the water outflow part may be separated from the main body by the user and rotated again by a predetermined angle to couple to each other again. In other words, the user may change the position of the water outflow part to a required position.

In the related art 1 configured as described above, the user has to directly separate and couple the water outflow part. As a result, there is a problem that the convenience of the user is deteriorated.

In addition, there is a problem that the components may be lost and damaged during the separation and coupling process. In addition, since the water outflow pipe is connected to the water outflow part through which the purified water is discharged, water leakage may occur during the separation and the coupling thereof.

In addition, since the water outflow part may be rotated only to a predetermined angle and coupled, there is a problem that the position of the water outflow part is limited. Particularly, the water outflow part may move only in a horizontal direction, and may not move in a vertical direction. Therefore, there is a problem that it is difficult to satisfy the demand of the user.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
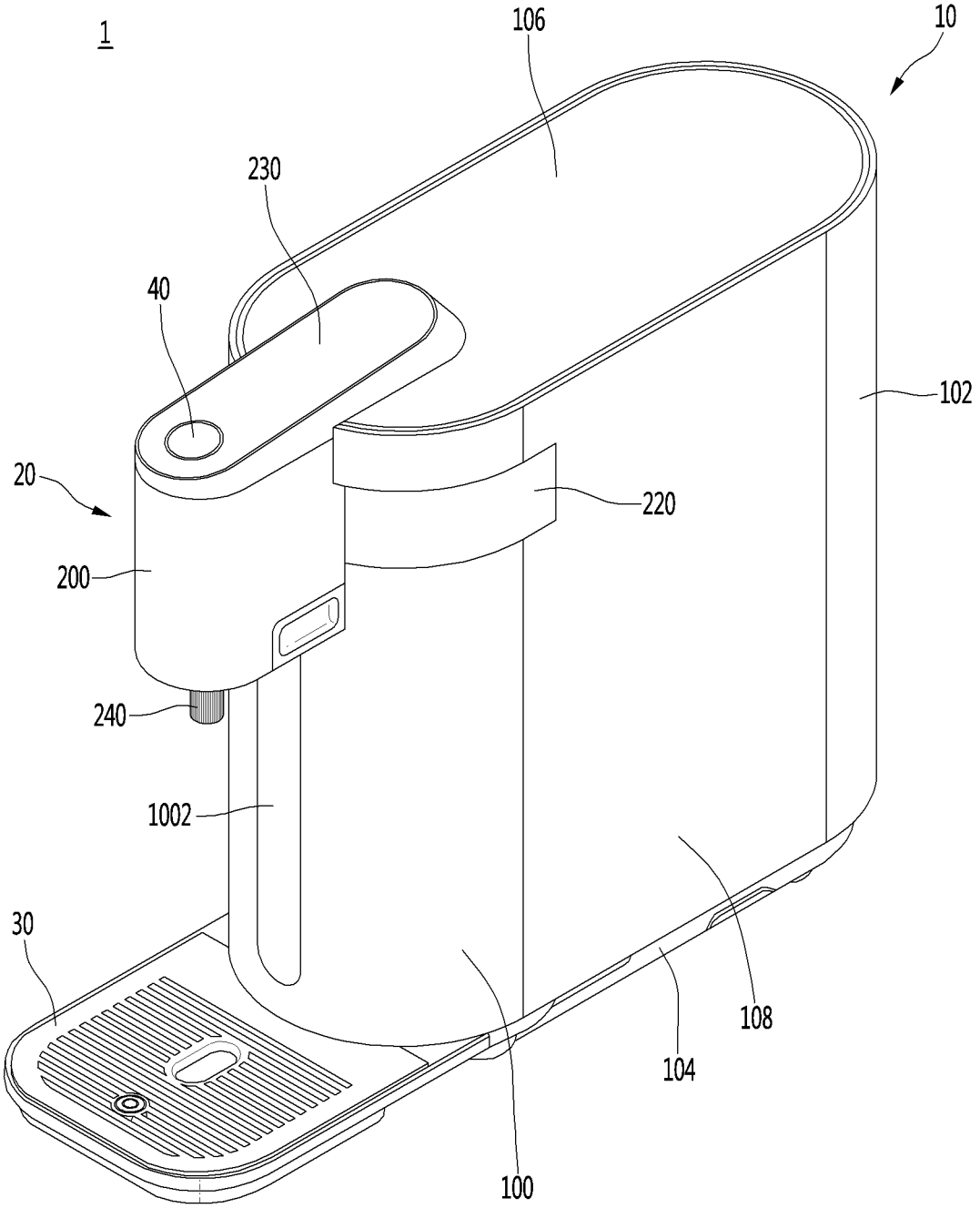
FIG. 1 illustrates a water purifier according to an embodiment of the present disclosure.

As illustrated in FIG. 1, a water purifier (or liquid dispenser) 1 according to an embodiment of the present disclosure may include a case 10 that forms an outer appearance and a water outflow unit (or dispenser) 20 coupled to a first side of the case 10. The case 10 may form an internal space in which various components to be described below are installed. For example, the case 10 may be provided in a cylindrical shape, as illustrated in FIG. 1. However, the cylindrical shape is an exemplary shape, and the case 10 may be provided in various shapes.

The case 10 may be formed by coupling a plurality of plates. The case 10 may include a front cover 100, a rear cover 102, a base cover 104, a top cover 106, and a pair of side covers 108. Each cover may form an outer appearance of a front surface, a rear surface, a lower surface, an upper surface, and both side surfaces of the water purifier 1.

Each of the covers may be coupled to each other via a coupling member or a coupling structure. The front cover 100 and the rear cover 102 may be spaced apart from each other in a front and rear direction, or a first direction. The pair of side covers 108 may respectively connect the front cover 100 and the rear cover 102 to each other to form the circumference of the water purifier 1.

The top cover 106 may be coupled to the upper ends of the front cover 100, the rear cover 102, and the pair of side covers 108. In addition, the base cover 104 may be coupled to the lower ends of the front cover 100, the rear cover 102, and the pair of side covers 108. The base cover 104 may be seated on a surface on which the water purifier 1 is installed.

The front cover 100 and the rear cover 102 may be bent at a predetermined curvature, and the pair of side covers 108 may be formed each as a flat plate. The front cover 100 and the rear cover 102 may be convexly formed in the first direction, respectively. The base cover 104 and the top cover 106 may correspond to the front cover 100 and the rear cover 102 and the front end and the rear end thereof may be rounded.

A flat part or insert 1002 may be formed in the center of the front cover 100 in a vertical direction. The flat insert 1002 may function as a center point of rotation of the dispenser 20, which will be described below.

In addition, the flat insert 1002 may be as a part recessed in the front cover 100 convexly protruding in the front direction. The front surface of the front cover 100 may correspond to a part in which a container such as a cup (hereinafter referred to as a water intake container or liquid container) which receives water or liquid by the user is disposed. Accordingly, the flat part 1002 may be formed so that the user may place the liquid container deeper and the liquid container may be stably supported.

In addition, the water purifier 1 may include a tray 30 on which the liquid container is seated. The tray 30 may be connected to the base cover 104 and protrude in the front direction. Therefore, the tray 30 may form the lower surface of the water purifier 1 together with the base cover 104.

The tray 30 may be located below a water outflow nozzle 240, to be described below, in the vertical direction. In addition, the tray 30 may include a structure for storing water not received in the water intake container. For example, the tray 30 may be provided in a shape in which a grill and a storage part below the grill are provided.

The dispenser 20 may be coupled to one side of the case 10 in a protruding manner. The dispenser 20 may protrude forward from the front cover 100 and the top cover 106. In addition, the dispenser 20 may communicate with and be coupled to the case 10.

The dispenser 20 may include a water outflow top cover (or dispenser top cover) 230, water outflow lifting covers (or dispenser lifting covers) 200 and 210, and a water outflow side cover (or dispenser side cover) 220. Each cover may form an outer appearance of the dispenser 20.

Figure 3:
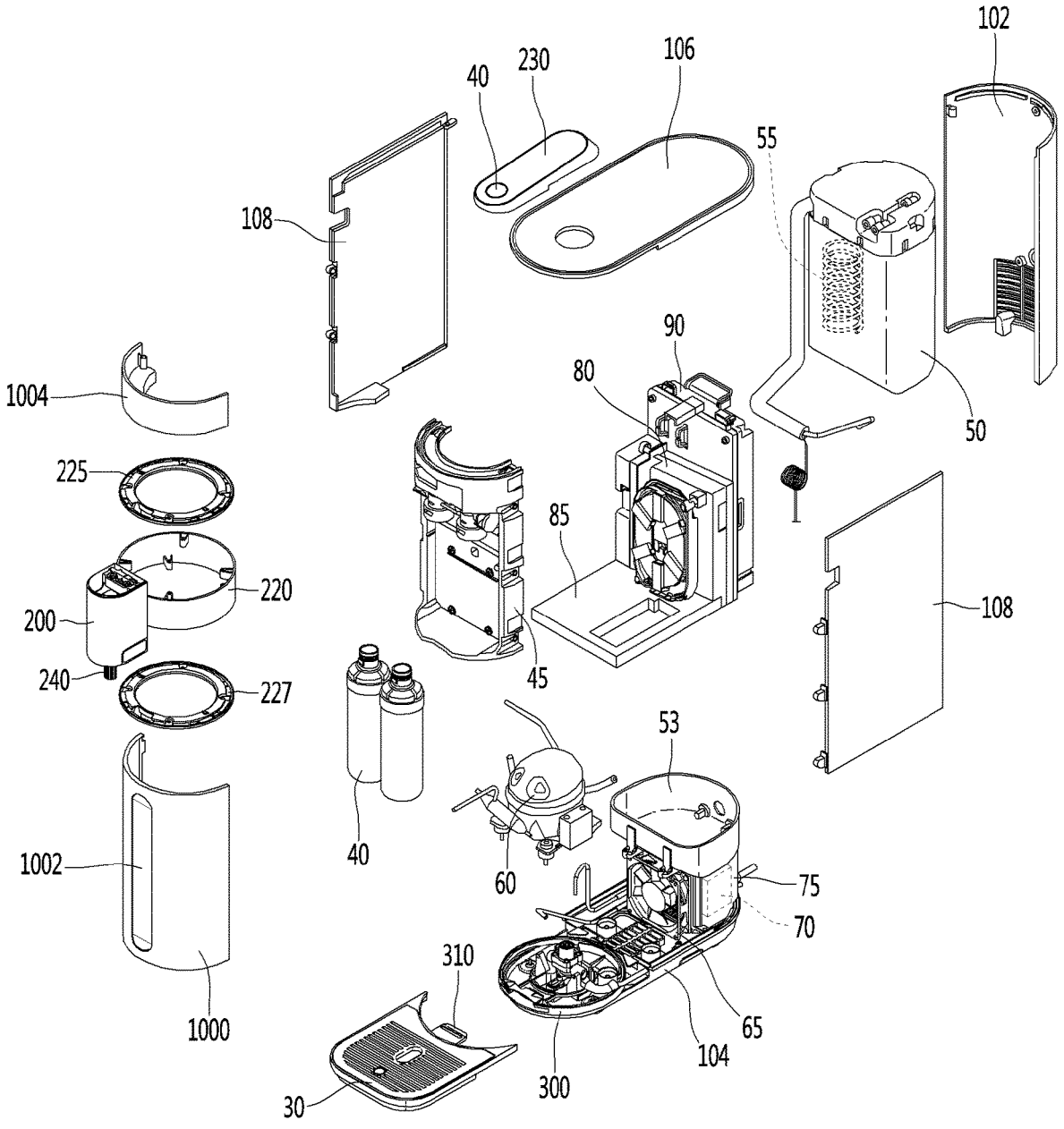
FIGS. 3 and 4 are exploded views illustrating a water purifier according to an embodiment.

The dispenser side cover 220 may correspond to a configuration which is seated in the case 10. Referring to FIG. 3, which will be described below, the dispenser side cover 220 may have a cylindrical shape corresponding to the curvature of the front cover 100. In addition, the dispenser side cover 100 may be provided so that the front cover 100 is divided into upper and lower parts. Accordingly, the front cover 100 may be divided into a lower front cover 1000 coupled to the base cover 104 and an upper front cover 1004 coupled to the top cover 106.

The upper front cover 1004 may have a smaller sectional area than the lower front cover 1000. Therefore, the upper front cover 1004 may be an auxiliary part that forms the outer appearance. The lower front cover 1000 may be formed with the flat insert 1002 and disposed on one side of the water intake container.

The dispenser lifting covers 200 and 210 may protrude from the front cover 100 in the front direction. The dispenser lifting covers 200 and 210 may protrude convexly from the dispenser side cover 220 in an outer direction. The dispenser top cover 230 may extend from the top cover 106 and cover the upper ends of the dispenser lifting covers 200 and 210.

The dispenser top cover 230 may include various input units (or inputs) 40 through which a user may input a predetermined command. The input 40 may be provided in various forms such as a button type and a touch type. In addition, although the input 40 is illustrated in FIG. 1 as one unit, the input 40 may be provided in various numbers.

The dispenser 20 may include a water outflow or dispenser nozzle 240 that releases a predetermined amount of water. The water outflow nozzle 240 may extend downward and may be exposed to a lower part of the dispenser lifting cover 200 and 210. As described above, the tray 30 may be provided below the water outflow nozzle 240 in a vertical direction.

A water outflow pipe connected to the water outflow nozzle 240 may be provided inside the dispenser 20. The water outflow pipe may extend from an inner part of the case 10 to the inside of the dispenser 20 and may be coupled to the water outflow nozzle 240.

The dispenser 20 of the water purifier 1 according to an embodiment may be moved so that the position of the water outflow nozzle 240 is changed. Hereinafter, this will be described in detail.

Figure 2:
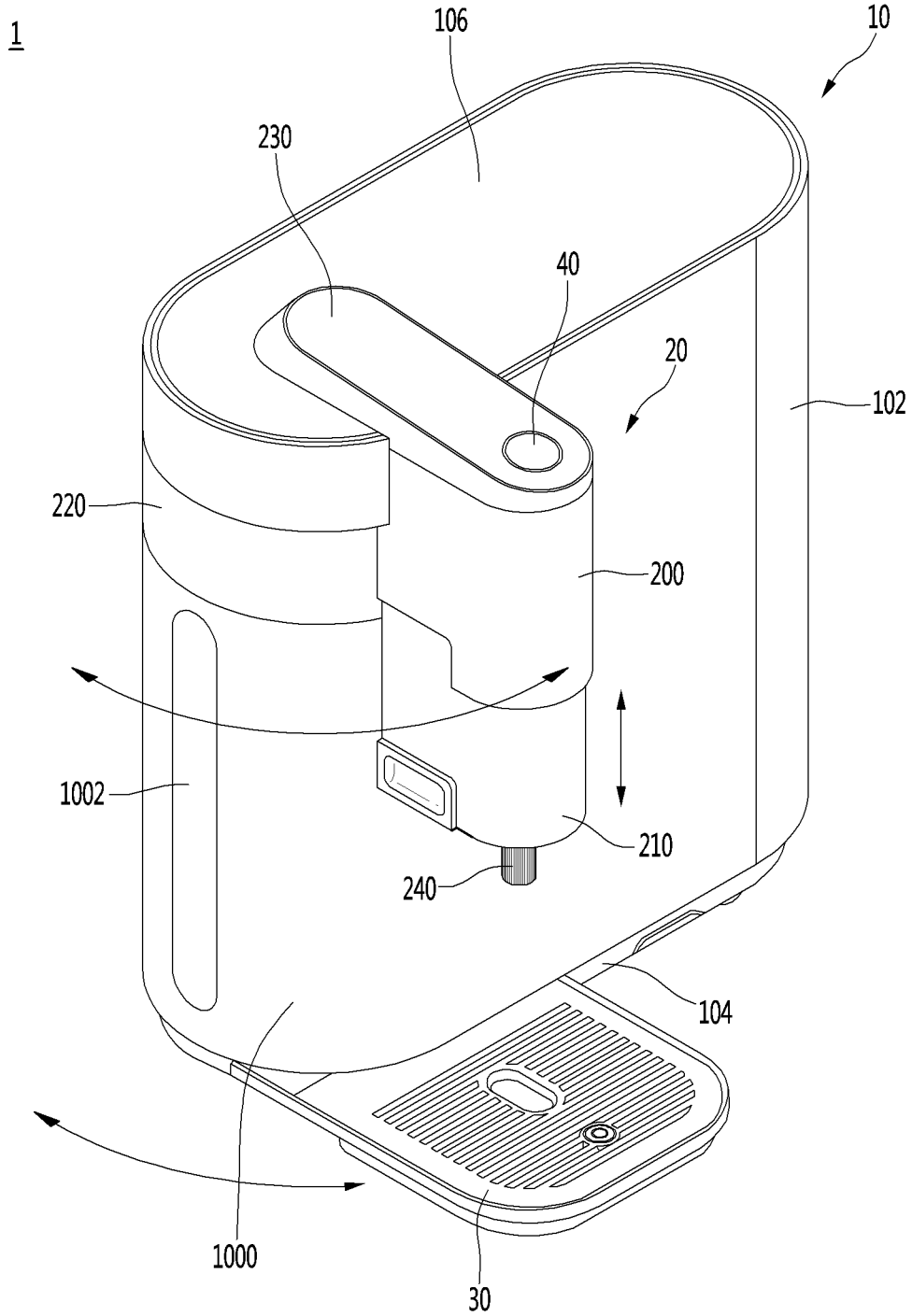
FIG. 2 illustrates a state where a position of a water outflow nozzle of a water purifier according to an embodiment is changed.

As illustrated in FIG. 2, the dispenser 20 may be rotated or lifted and lowered. Accordingly, the water outflow nozzle 240 may be rotated or lifted and lowered. In addition, the tray 30 may be rotated according to the rotation of the water outflow nozzle 240.

First, the rotation of the dispenser 20 will be described. The dispenser 20 may be rotated as the dispenser side cover 220 is rotated. In other words, as the dispenser side cover 220 is rotated, the dispenser lifting cover 200 and 210, the dispenser top cover 230, and the dispenser nozzle 240 may be rotated.

The dispenser 20 may be rotated along the front cover 100 and may have a rotation radius of about 180 degrees. In addition, since the input 40 is formed on the water outflow top cover 230, the input 40 may be rotated together with the dispenser 20 so that the convenience of the user can be corrected.

The tray 30 may be rotatably coupled to the base cover 104 and may rotate in correspondence with the dispenser 20. Therefore, the tray 30 may also have a rotation radius of about 180 degrees.

The dispenser lifting cover may include a first lifting cover 200 and a second lifting cover 210 movably coupled to the first lifting cover 200. The first lifting cover 200 may be fixed to the water outflow side cover 220.

The dispenser top cover 230 may be coupled to the upper end of the first lifting cover 200. The second lifting cover 210 may be provided inside the first lifting cover 200 and may be moved along the first lifting cover 200. The water outflow nozzle 240 may be installed on the second lifting cover 210 and may be moved together with the second lifting cover 210.

The rotation and lifting and lowering of the dispenser 20 may be performed independently of each other. In other words, the rotation and lifting and lowering of the dispenser 20 may be performed simultaneously or separately. For example, the rotation of the dispenser 20 may be performed according to the installation site, and the lifting and lowering of the dispenser 20 may be performed according to the height of the water intake container.

The dispenser 20 may include a structure which is rotated or lifted and lowered. In other words, the dispenser 20 may be provided in a structure which is not rotated but is lifted and lowered. Accordingly, the dispenser side cover 220 may be fixedly disposed in the case 10.

Figure 4:
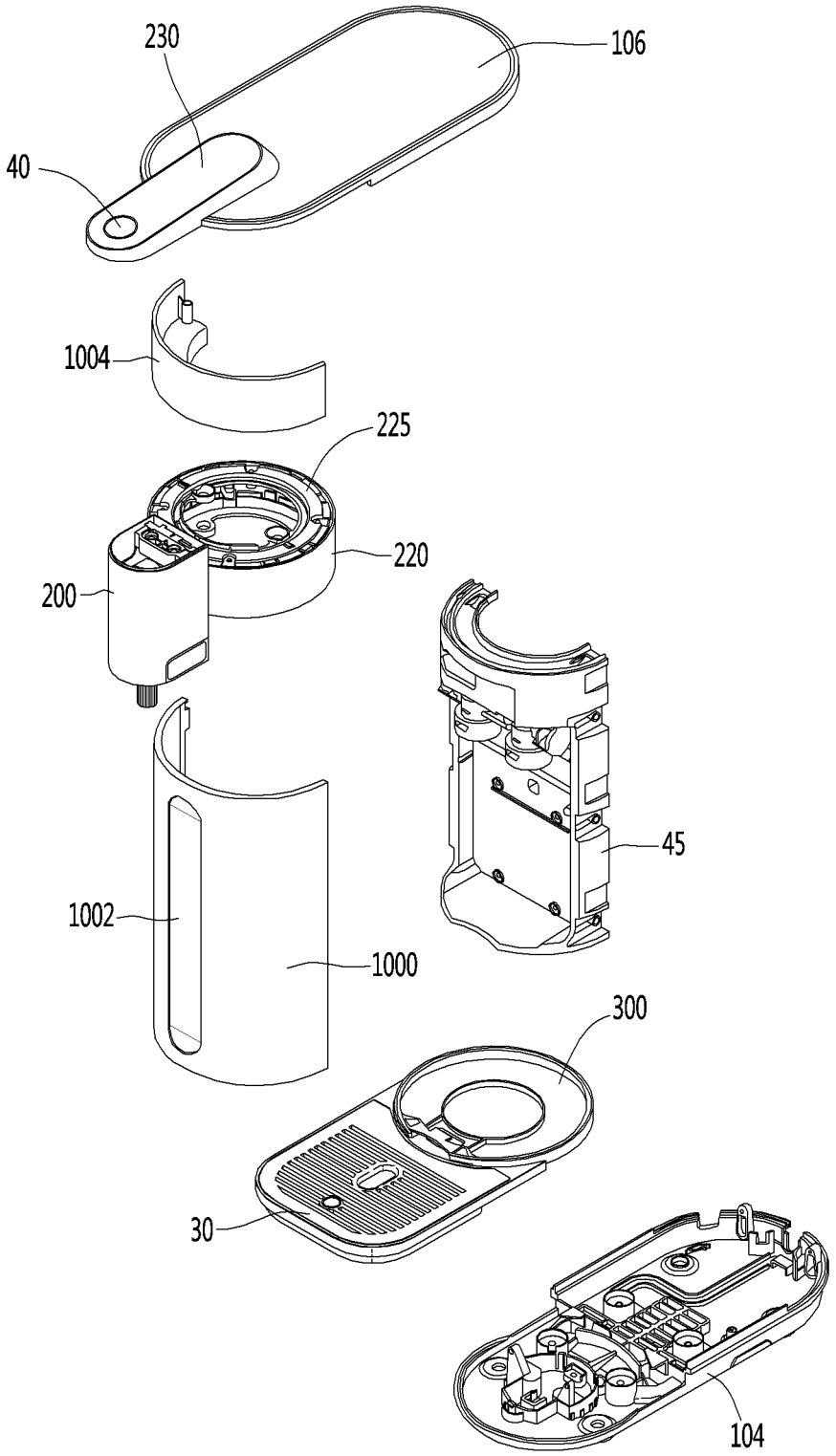

The water purifier 1 illustrated in FIGS. 3 and 4 may have a configuration capable of supplying purified water or liquid, cold water or liquid, and hot water or liquid. However, this is an illustrative example, and the configuration of the water purifier 1 is not limited thereto and may be omitted or added.

In addition, FIGS. 3 and 4 are illustrated in a state where a pipe through which water flows for convenience of description is omitted.

As illustrated in FIGS. 3 and 4, the water purifier 1 may include a filter 40, a cooling tank 50, a compressor 60, a condenser 70, and an induction heating assembly 80, which are disposed in the case 10. In addition, a filter bracket 45 on which the filter 40 may be mounted is provided in the case 10.

The filter bracket 45 may be seated on the base cover 104 adjacent to the front cover 100. The dispenser side cover 220 may be seated on the filter bracket 45. In other words, the filter bracket 45 may have a height corresponding to a height of the lower front cover 1000.

The upper and lower ends of the filter bracket 45 may be provided in a form of a semi-circle having a curvature corresponding to the front cover 100. The filter bracket 45 may form a space recessed in a rear direction so that the filter 40 may be received.

The filter 40 may be provided in a space formed between the filter bracket 45 and the front cover 100. The filter 40 may combine filters having various functions for purifying raw water (tap water) to be supplied. In other words, the filter 40 may be provided in various numbers and various shapes.

The filter bracket 45 may include various valves to be connected to the respective pipes. For example, a pipe through which the water flowing into the filter 40 flows, a pipe through which the purified water through the filter 40 flows, or the like may be connected.

Purified water at the filter 40 may be supplied to the cooling tank 50 and the induction heating assembly 80 or the water outflow nozzle 240. In other words, the purified water at the filter 40 may be supplied in a form of cold water, hot water, or purified room temperature water.

The compressor 60 and the condenser 70 together with an evaporator 55 disposed inside the cooling tank 50 may form a refrigeration cycle. In other words, the compressor 60 and the condenser 70 may be understood as a configuration for supplying cold water.

The compressor 60 and the condenser 70 may be seated on the base cover 104. The compressor 60 and the condenser 70 may be arranged behind the filter bracket 45. A cooling fan 65 may be provided between the compressor 60 and the condenser 70. The cooling fan 65 may cool the compressor 60 and the condenser 70.

The compressor 60 may use an inverter-type compressor capable of adjusting the cooling capacity by varying the frequency. Therefore, purified water may be efficiently cooled, thereby reducing power consumption. The condenser 70 may be located at a position corresponding to the discharge port formed in the rear cover 102. The condenser 70 may be formed by bending the flat tube-type refrigerant tube several times in order to efficiently use the space and improve the heat exchange efficiency.

The condenser 70 may be received and disposed on the condenser bracket 75. The condenser bracket 75 may form space having a shape corresponding to the overall shape of the condenser 70 so as to receive the condenser 70. The condenser bracket 75 may be formed such that the cooling fan 65 and the part facing the discharge port of the rear cover 102 are opened, respectively, so that the condenser 70 may be effectively cooled.

A tank mounting part or dock 53, in which the cooling tank 50 is received, may be provided at an upper part of the condenser bracket 75. The tank mounting dock 53 may fix the cooling tank 50. For example, the tank mounting dock 53 may be provided so that the lower end part of the cooling tank 50 is inserted.

The cooling tank 50 may cool the purified water to produce cold water and may be filled with cooling water to heat exchange with the purified water which flows therein. An evaporator 55 for cooling the cooling water may be received in the cooling tank 50. In addition, the purified water may be cooled by allowing the purified water to pass through the inside of the cooling tank.

The induction heating assembly 80 may heat purified water in an induction heating (IH) manner. The induction heating assembly 80 may instantaneously and rapidly heat the water at the hot water discharge operation and may control the output of the magnetic field to heat the purified water to the desired temperature and provide the purified water to the user. Therefore, hot water having a desired temperature may be discharged according to the user's operation.

The induction heating assembly 80 may be seated and installed in the support plate 85. The support plate 85 may extend from the filter bracket 45 to the cooling tank 50. In addition, the support plate 85 may be provided above the compressor 60.

The water purifier 1 may include a control unit or controller 90. The controller 90 may control the operation of the water purifier 1 by controlling the above-described configurations. The controller 90 may control the compressor 60, the cooling fan 65, various valves, sensors, the induction heating assembly 80, or the like. The controller 90 may be configured in a modular manner by a combination of PCBs divided into a plurality of parts according to the functions thereof.

The controller 90 may heat the purified water together with the induction heating assembly 80. Accordingly, the controller 90 may be provided on one side of the induction heating assembly 80. The controller 90 may be combined with the induction heating assembly 80 in a single module state and may be seated in the support plate 85.

The water purifier 1 may include a rotation structure of the dispenser 20. In other words, a structure configured to rotate the dispenser side cover 220 and the tray 30 may be provided.

As illustrated in FIGS. 3 and 4, rotation mounting parts or rings 225 and 227 may be coupled with the dispenser side cover 220. The rotation mounting rings 225 and 227 may each have an outer diameter corresponding to the dispenser side cover 220.

For example, the rotation mounting rings 225 and 227 may include guide rails, and the dispenser side cover 220 may be slidably moved along the guide rails. The rotation mounting rings 225 and 227 may also include a pair of plates between which a ball bearing or a roller is disposed.

The rotation mounting part may include an upper rotation mounting part or ring 225 coupled to an upper end of the dispenser side cover 200 and a lower rotation mounting part or ring 227 coupled to a lower end. The lower rotation mounting ring 227 may be fixed to the upper end of the filter bracket 45. The upper rotation mounting ring 225 may be fixed to the lower end of the upper front cover 1104.

As illustrated in FIGS. 3 and 4, a tray mounting part or bracket 300 coupled to the tray 30 may be provided. The tray mounting bracket 300 may be fixed to the base cover 104 and may be provided in a ring shape having an outer diameter corresponding to the front end of the base cover 104.

The tray 30 may include a tray hook 310 coupled to the tray mounting bracket 300. In other words, the tray 30 may be detachably hooked to the tray mounting bracket 300. Accordingly, the user may easily separate and clean the tray 30.

Figure 5:
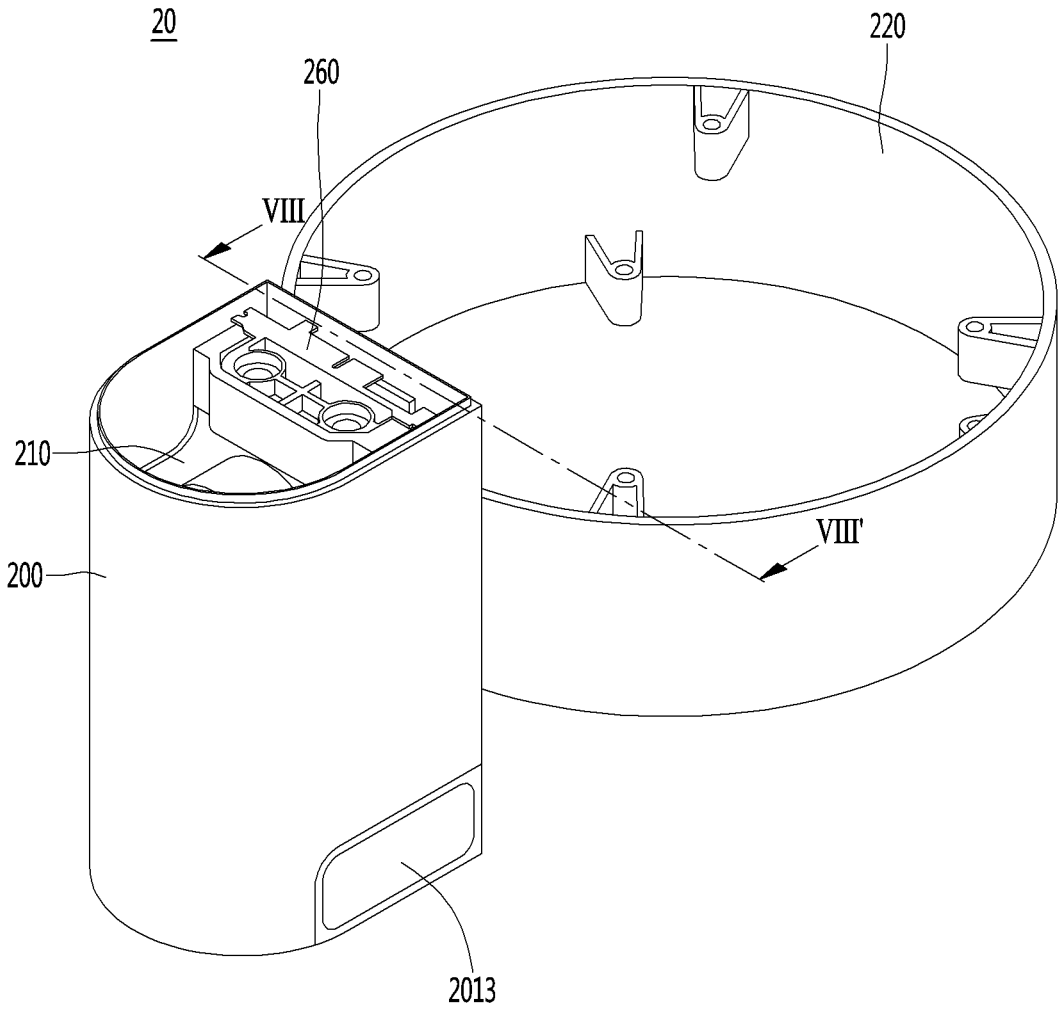
FIG. 5 illustrates a water outflow unit of a water purifier according to an embodiment.
Figure 6:
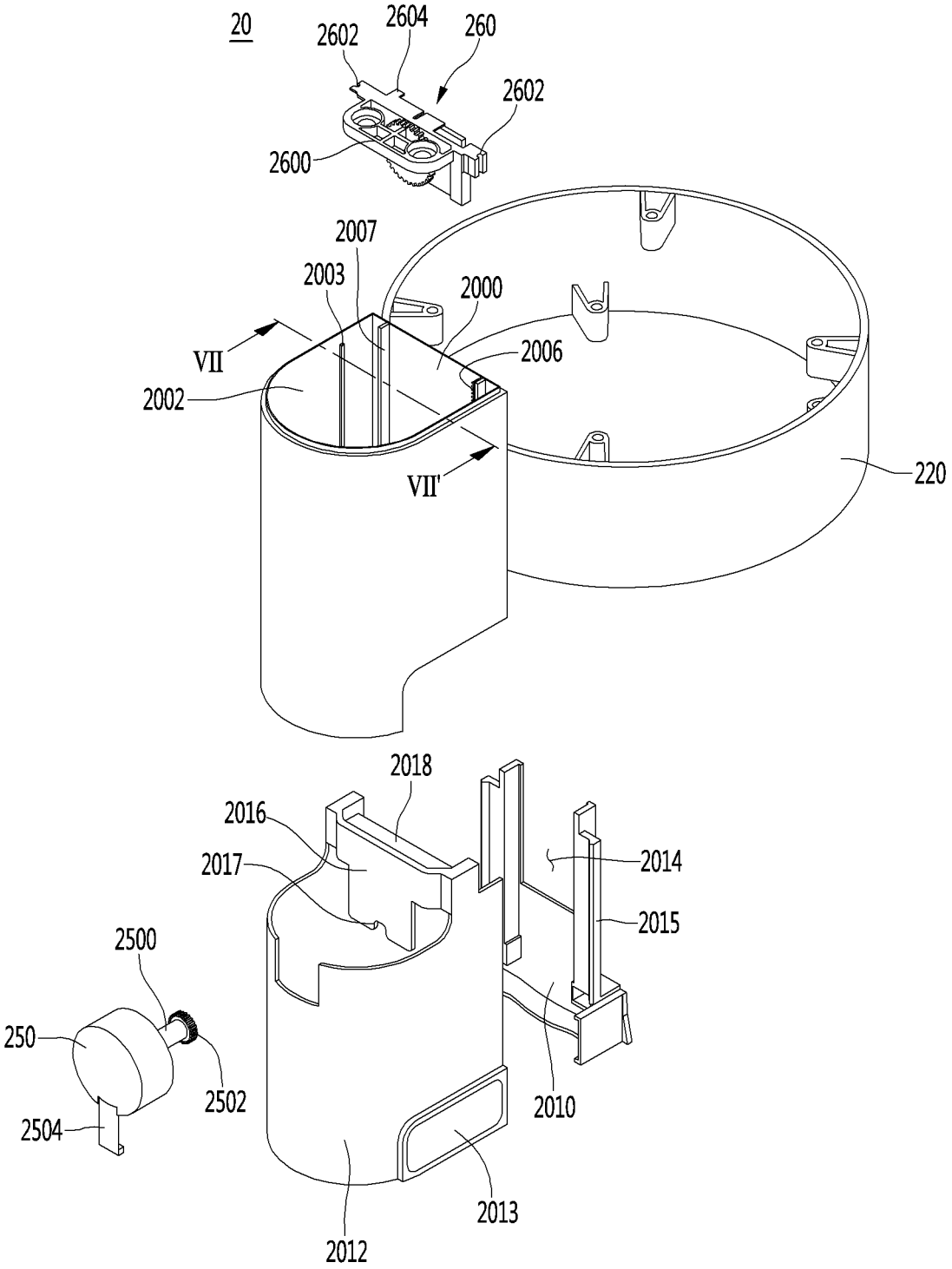
FIG. 6 is an exploded view illustrating the water outflow unit of a water purifier according to an embodiment.

As illustrated in FIGS. 5 and 6, the dispenser 20 may include the dispenser lifting covers 200 and 210 and the dispenser side cover 220. The first lifting cover 200 and the second lifting cover 210 may be included in the dispenser lifting covers. For the convenience of explanation, the dispenser top cover 230 and the water outflow nozzle 240 are omitted in the Figures.

As described above, the first lifting cover 200 may be fixed and the second lifting cover 210 may be moved. However, this is an example, and the first and second lifting covers 200 and 210 may be provided in various forms which are relatively movable. For example, all the first and second lifting covers 200 and 210 may be movable.

As described above, the dispenser side cover 220 may be provided in a cylindrical shape. In particular, the front side of the dispenser side cover 220 may form an outer appearance of the front surface of the water purifier 1 together with the front cover 100.

The first lifting cover 200 may be coupled to the outside of the dispenser side cover 220. The first lifting cover 200 may include a first plate 2000 coupled to the dispenser side cover 220 and a second plate 2002 extending from the first plate 2000. The first plate 2000 and the second plate 2002 may be divided for convenience of description or may be integrally formed with each other.

The first plate 2000 may be provided as a flat plate having a predetermined thickness. Alternatively, the first plate 2000 may be provided in a shape of a curved plate having a curvature corresponding to the dispenser side cover 220. At this time, FIG. 7 corresponds to a view illustrating the first plate 2000 in a state of cutting the second plate 2002.

Figure 7:
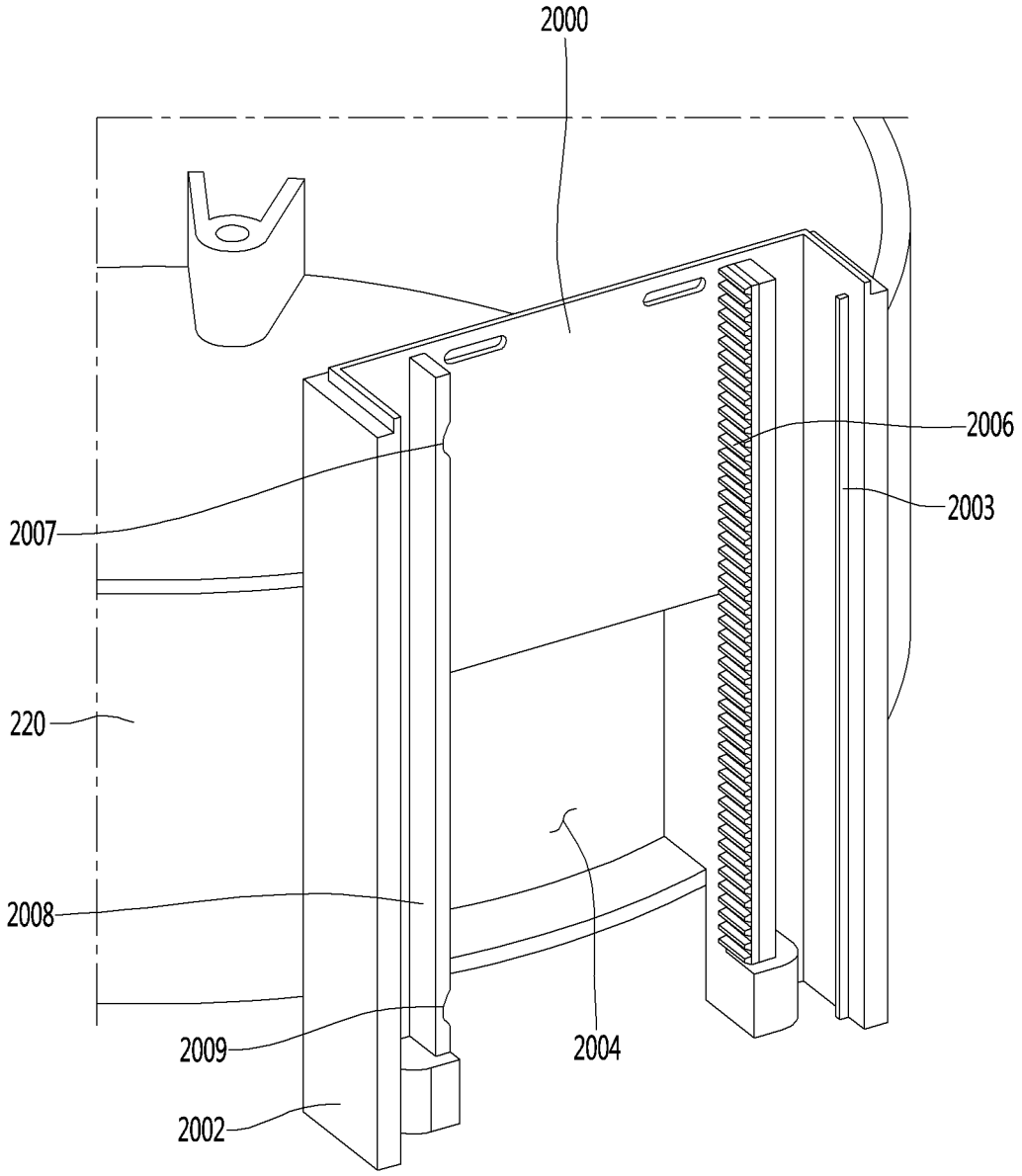
FIG. 7 is a sectional view taken along line VII-VII' of FIG. 6.

Referring to FIG. 7, the first plate 2000 may include a water outflow opening 2004 communicating with the inner space of the case 10. The dispenser side cover 220 may also include a through-hole corresponding to the water outflow opening 2004. The water outflow opening 2004 may correspond to a hole through which the water outflow pipe extending to the water outflow nozzle 240 passes.

A lifting gear 2006 and guide rail 2008 extending in the vertical direction may be formed on the first plate 2000. One surface of the first plate 2000 on which the lifting gear 2006 and the guide rail 2008 are formed may be referred to as an inner surface and one surface of the first plate 2000 coupled to the water outflow side cover 220 may be referred to as an outside.

The lifting gear and the guide rail 2008 may protrude from the inner surface of the first plate 2000. The lifting gear 2006 and the guide rail 2008 may extend from the upper end to the lower end of the first plate 2000 in the vertical direction.

The lifting gear 2006 and the guide rail 2008 may be provided on both sides of the water outflow opening 2004, respectively. On FIG. 7, the lifting gear 2006 is located on the right side of the water outflow opening 2004, and the guide rail 2008 is located on the left side of the water outflow opening 2004. In other words, the lifting gear 2006 and the guide rail 2008 may be spaced from each other in the horizontal direction and extend in parallel in the vertical direction.

The lifting gear 2006 may correspond to a straight rack. In other words, the lifting gear 2006 may have gear teeth provided sequentially in the vertical direction. In the lifting gear 2006, the gear teeth may be formed the one side surface, specifically, on the left surface of the lifting gear 2006 so as to face the water outflow opening 2004.

The guide rail 2008 may be provided in a smoothly extended rod shape. At this time, a plurality of seating grooves 2007 and 2009 may be formed on one surface, for example, the right surface, of the guide rail 2008 facing the lifting gear 2006. The plurality of seating grooves 2007 and 2009 may be recessed to the left side from the right side surface of the guide rail 2008.

The plurality of seating grooves 2007 and 2009 may include a first seating groove 2007 and a second seating groove 2009 located below the first seating groove 2007. Particularly, the first seating groove 2007 may be adjacent to the upper end of the guide rail 2008, and the second seating groove 2009 may be adjacent to the lower end of the guide rail 2008.

The first seating groove 2007 and the second seating groove 2009 may be spaced apart from each other almost by a maximum distance. The distance between the first seating groove 2007 and the second seating groove 2009 may correspond to a distance at which the second lifting cover 210 is moved.

The second plate 2002 may correspond to a plate which is convexly extended at both ends of the first plate 2000. In other words, the second plate 2002 may correspond to a plate coupled to both ends of the first plate 2000 in a curved shape. Accordingly, a predetermined space may be formed between the first plate 2000 and the second plate 2002.

The space may be opened in the vertical direction. In other words, upper and lower parts of the first lifting cover 200 may be opened. The upper part of the first lifting cover 200 may be coupled to the dispenser top cover 230 and may be closed. In addition, the lower part of the first lifting cover 200 may be closed by the second lifting cover 210.

One surface of the second plate 2002 forming such space may be referred to as an inner surface, and a surface opposite thereto may be referred to as an outer surface. The outer surface of the second plate 2002 may protrude to a front side of the water purifier 1 and may correspond to a surface which forms an outer appearance. Accordingly, the outer surface of the second plate 2002 may be smoothly formed for aesthetic purposes.

The inner surface of the second plate 2002 may be smooth so that the first lifting cover 210 may be moved. Guide protrusions 2003 protruding in the lateral direction may be formed on the inner surface of the second plate 2002. The guide protrusion 2003 may extend from the upper end to the lower end of the second plate 2002 in the vertical direction.

The guide protrusion 2003 may be formed adjacent to the guide rail 2007 and the lifting gear 2009, respectively. FIG. 6 illustrates the guide protrusion 2003 adjacent to the guide rail 2007 and FIG. 7 illustrates the guide protrusion 2003 adjacent to the lifting gear 2006.

The second lifting cover 210 may be provided inside the first lifting cover 200. The second lifting cover 210 may be provided in the space formed by the first plate 2000 and the second plate 2002 of the first lifting cover 200. The second lifting cover 210 may be moved downward from the inside of the first lifting cover 200.

The second lifting cover 210 may have a shape corresponding to the first lifting cover 200. The second lifting cover 210 may have a first plate 2010 and a second plate 2012 similar to the first lifting cover 200. The first plate 2010 and the second plate 2012 of the second lifting cover 210 are illustrated separately in FIG. 6, but, as an example, the first plate 2010 and the second plate 2012 thereof may be integrally formed.

Accordingly, a predetermined space may also be formed in the second lifting cover 210 by the first plate 2010 and the second plate 2012. The upper end of the second lifting cover 210 may be opened and may be cut to have a predetermined shape for coupling with a lifting motor 250 and a gear module 260 to be described below.

A structure in which the water outflow nozzle 240 is installed may be provided at the lower end of the second lifting cover 210. For example, the lower part of the second lifting cover 210 may include an opening through which the water outflow nozzle 240 is inserted and coupled.

The first plate 2010 may include a water outflow groove 2014 corresponding to the water outflow opening 2004. The outflow groove 2014 may be formed at a position corresponding to the water outflow opening 2004 when the second lifting cover 210 is lifted. Accordingly, the water outflow pipe may extend through the water outflow opening 2004 and the water outflow groove 2014.

In addition, an auxiliary guide rail 2015 may be formed on the first plate 2010. The auxiliary guide rail 2015 may protrude toward both side surfaces and extend in the vertical direction. The auxiliary guide rail 2015 may guide movement in contact with the guide protrusion 2003.

The second plate 2012 may include a grip part (or grip) 2013 which may be gripped by a user. The grip 2013 may be located below both side surfaces of the second plate 2012. The first lifting cover 200 may be provided in a cut shape so that the grip 2013 may be exposed to the outside even in a state where the second lifting cover 210 is lifted.

The grip 2013 may correspond to an auxiliary configuration in which the user manually moves the second lifting cover 210. The grip 2013 may be provided in various forms so that the user may conveniently move the second lifting cover 210.

The second plate 2012 may include a lifting bracket 2016 coupled to the lifting motor 250 and the gear module 260 to be described below. The lifting bracket 2016 may include a motor coupling part or groove 2017 to which the lifting motor 250 is coupled and a gear seating part or groove 2018 to which the gear module 260 is coupled. The dispenser 20 may further include the lifting motor 250 and the gear module 260 interlocked with the lifting motor 250.

The lifting motor 250 may include an electric wire 2504 connected to an external power source, a motor shaft 2500 rotated by power supply, and a motor gear 2502 connected to the motor shaft 2500. The motor gear 2502 may correspond to a spur gear with gear teeth cut parallel to the motor shaft 2500.

As described above, the lifting motor 250 may be coupled to the motor coupling groove 2017. In other words, the lifting motor 250 may be coupled to the second lifting cover 210. The lifting motor 250 may be coupled to the second lifting cover 220 such that the motor shaft 2500 extends in the horizontal direction and the motor gear 2502 may be arranged towards a rear of the water purifier 1.

The gear module 260 may include a plurality of gears rotated by the lifting motor 250. A gear bracket 2600 for rotatably fixing a plurality of gears may be provided. The gear bracket 2600 may be seated on the motor coupling groove 2017 and coupled by a coupling member.

The gear bracket 2600 may include gear guide protrusions 2602 protruding from both side surfaces and in contact with the guide protrusions 2003. A pair of gear guide protrusions 2602 may be provided spaced apart from each other and protruding so that the guide protrusion 2003 is disposed between the gear guide protrusions. In other words, the guide protrusion 2003 and the gear guide protrusion 2602 may be fitted to each other. Accordingly, the gear bracket 2600 may be guided along the guide protrusion 2003 in the vertical direction.

The gear bracket 2600 may include guide rail protrusions 2604 protruding rearward. The guide rail protrusions 2604 may be in contact with the inner surface of the guide rail 2008. Accordingly, the gear bracket 2600 may be guided along the guide rail 2008 in the vertical direction.

The guide rail protrusions 2604 may be brought into close contact with the inner surface of the guide rail 2008 to receive an external force. A force pushing the inside surface of the guide rail 2008 to the outside may be applied to the guide rail protrusion 2604. Accordingly, the guide rail protrusions 2604 may be inserted into the first and second seating recesses 2007 and 2009.

Figure 8:
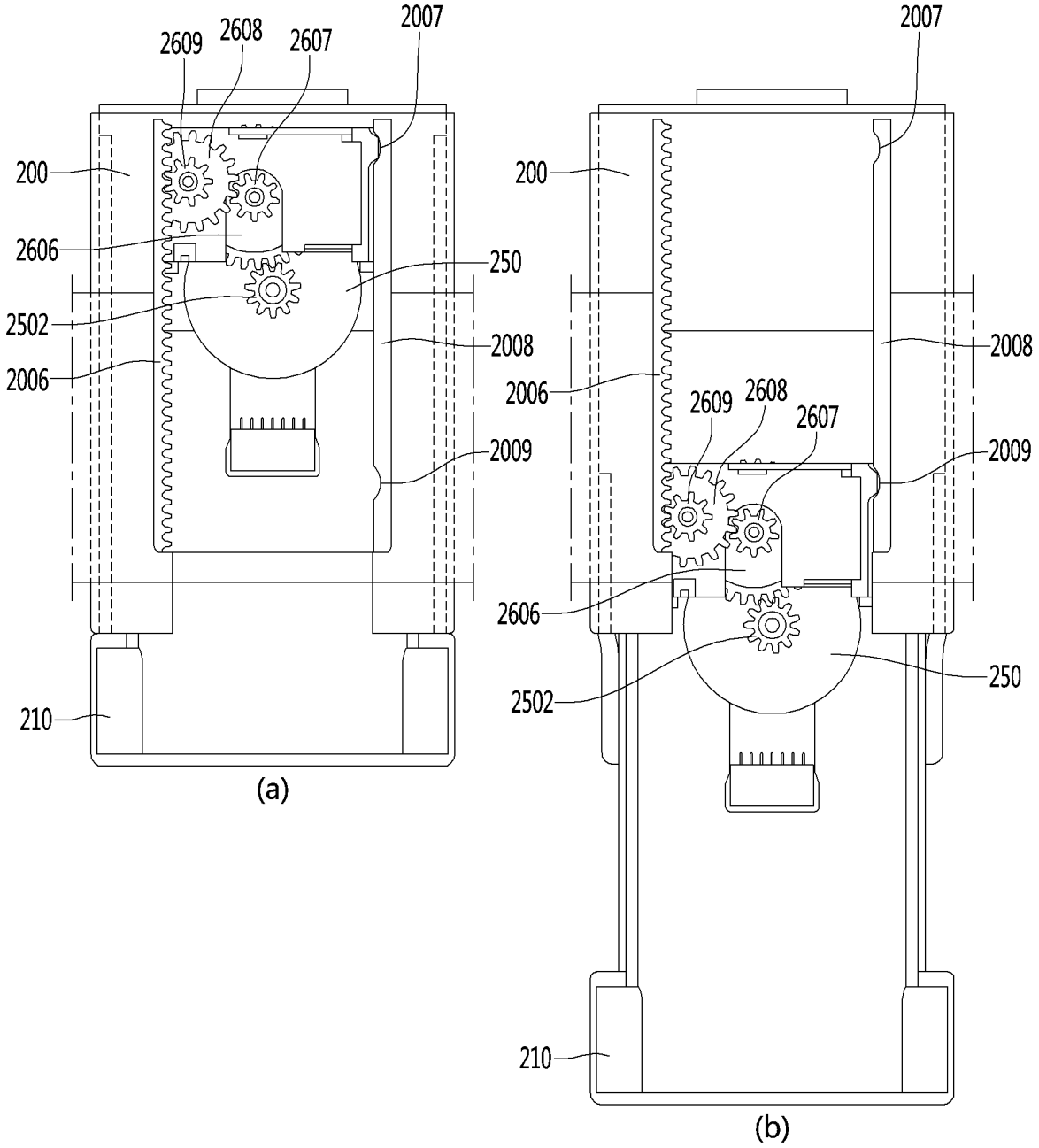
FIG. 8 is a view illustrating section VIII-VIII' of FIG. 5 together with the movement.

Referring to FIG. 8, the gear module 260 may include a first gear 2606, a second gear 2607, a third gear 2608, and a fourth gear 2609 mounted on the gear bracket 2600. The number and shape of the gears may correspond to the illustrative examples.

The first gear 2606 may be a gear engaged with the motor gear 2402. The second gear 2607 may be coaxially connected to the first gear 2606. The first gear 2606 and the second gear 2607 may be formed as one gear.

The third gear 2608 may be a gear engaged with the second gear 2607. The fourth gear 2609 may be coaxially connected to the third gear 2608. The third gear 2608 and the fourth gear 2609 may be formed as one gear.

The fourth gear 2609 may engage with the lifting gear 2608. The lifting gear 2608 may be formed on the first lifting cover 200 and may have a fixed configuration. The fourth gear 2609 may be mounted on the gear bracket 2600 and correspond to a configuration coupled to the second lifting cover 210. Accordingly, as the fourth gear 2609 rotates, the second lifting cover 210 may be moved.

Referring to FIG. 8, the lifting and lowering of the second lifting cover 210 will be described. FIG. 8 (*a*) illustrates a state where the second lifting cover 210 is lifted, and FIG. 8 (*b*) illustrates a state where the second lifting cover 210 is lowered.

In addition, FIG. 8 (*a*) illustrates a state where the guide rail protrusion 2604 is inserted into the first seating groove 2007, and FIG. 8 (*b*) illustrates a state where the guide rail protrusion 2604 is inserted into the second seating groove 2009. Therefore, the second lifting cover 210 may be moved by the separation distance of the first and second seating grooves 2009.

The water outflow nozzle 240 installed on the second lifting cover 210 may be lifted or lowered by the movement distance of the second lifting cover 210. Hereinafter, a control method of the water purifier 1 will be described based on such a configuration.

Figure 9:
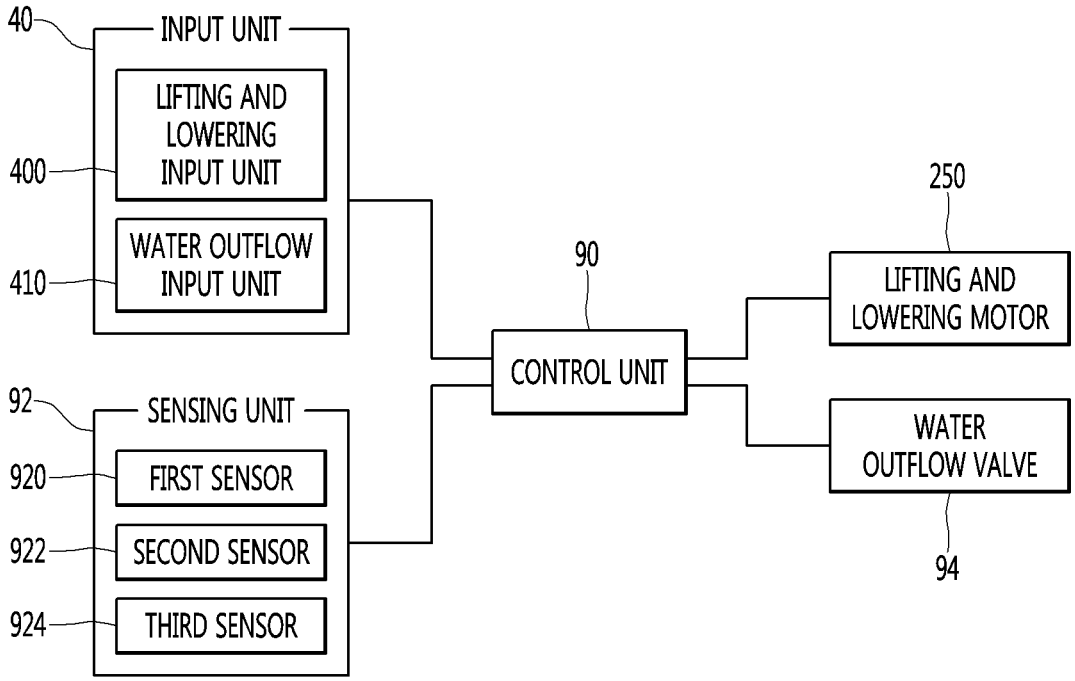
FIG. 9 illustrates a control configuration of a water purifier according to an embodiment.

As illustrated in FIG. 9, the water purifier 1 may include the controller 90 for controlling various configurations. The controller 90 may be installed inside the case 10 as described above. In addition, the controller 90 may be provided separately from the water purifier 1.

The controller 90 may control the operation of the lifting motor 240. The second lifting cover 210 and the water outflow nozzle 240 may be lifted and lowered by the operation of the lifting motor 240. In other words, the controller 90 may control the lifting and lowering of the water outflow nozzle 240.

The controller 90 may control the operation of the water outflow valve 94. The water outflow valve 94 may open and close the water outflow nozzle 240. In other words, the controller 90 may control the water outflow and the water outflow stop.

The controller 90 may control the operation of the lifting motor 240 and the water outflow valve 94 according to a signal of a sensing unit or sensor 92 provided at the input 40 or various sensors. For example, the input 40 may include a lifting input unit 400 and a water outflow input unit 410. In addition, the sensor 92 may include a plurality of sensors 920, 922, and 924.

Hereinafter, the control by the input 40 may be described as a first embodiment, and the control by the sensing unit 92 may be described as a second embodiment. However, such control is illustrative and not limited thereto.

Figure 10:
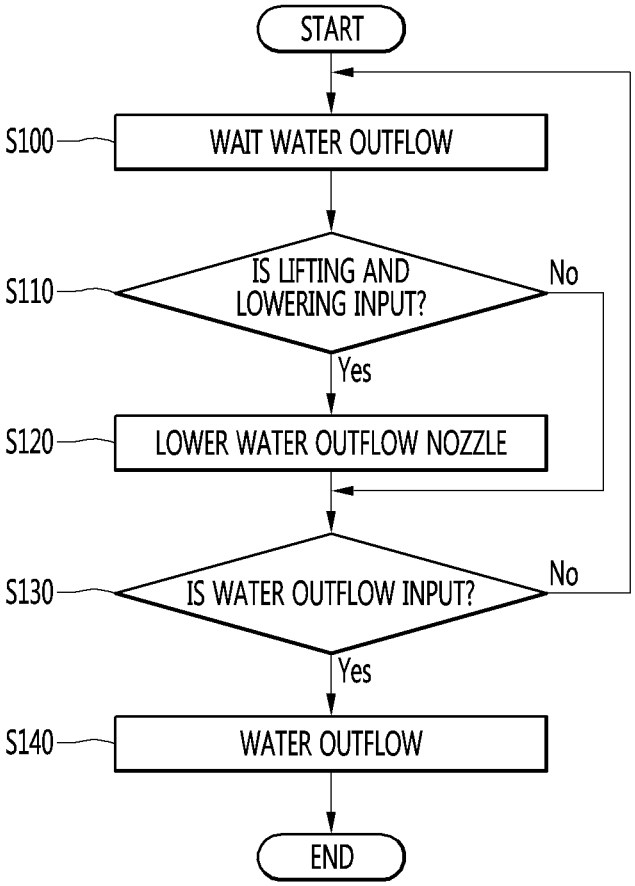
FIG. 10 illustrates a control flow of the water purifier according to the first embodiment.

FIG. 10 illustrates a flow in which the water purifier 1 is controlled as a user inputs a predetermined command to the input 40. In particular, the water purifier 1 may be controlled by the lifting input unit 400 and the water outflow input unit 410. At this time, the lifting input unit 400 and the water outflow input unit 410 may be provided as separate buttons.

Referring to FIG. 9, when explaining FIG. 10, the water purifier 1 may be in a water outflow waiting state (or idle or standby state) (S100). The water outflow waiting state may mean that power is connected to the water purifier 1, but water is not being dispensed. Then, it is determined whether or not there is an input to the lifting input unit 400 (S110). If there is an input to the lift input unit 400, the water out flow nozzle 420 may be lowered. In other words, when the user presses or touches the lifting input unit 400, the second lifting cover 210 may be moved downward.

The controller 90 may drive the lifting motor 240 according to a signal of the lifting input unit 400. Accordingly, the motor shaft 2500 may be rotated and power may be transmitted to the gear module 260. The fourth gear 2609 may be rotated along the lifting gear 2006 to lower the second lifting cover 210.

When the guide rail protrusion 2604 is inserted into the first seating groove 2007, the guide rail protrusion 2604 may exit from the first seating groove 2007 by the operation of the lifting motor 24. In addition, the guide rail protrusion 2604 may be lowered along the guide rail 2008.

The guide rail protrusion 2604 may be moved to the second seating groove 2009 while being continuously lowered. The guide rail protrusion 2604 may be inserted into the second seating groove 2009. Accordingly, the lifting motor 240 may be temporarily subjected to a large load.

When the load is input, the controller 90 may determine that the lowering is completed and stop the driving of the lifting motor 240. In other words, the second lifting cover 210 and the water outflow nozzle 240 may be lowered until the guide rail protrusion 2604 is inserted into the second seating groove 2009.

The controller may then determine whether or not there is an input to the water outflow input unit 410 (S130). If there is an input to the water outflow input unit 410, the water outflow valve 94 may be opened and water may be discharged to the water outflow nozzle 420 (S140). The water to be discharged may be purified water, cold water or hot water according to the user's selection or setting.

If there is no input to the lifting input unit 400, water outflow may be performed when there is an input of the water outflow input unit 410. In other words, the water outflow nozzle 240 may be lowered or water outflow may be performed at the original position according to the user's selection.

In a case where water is discharged in a state where the water outflow nozzle 240 is lowered, the second lifting cover 210 may be lifted to the original position thereof again when the water discharge is completed. At this time, the lifting of the water outflow nozzle 240 may be set after a predetermined time elapses after the input of the water discharge or the lifting input unit 400 is completed.

The controller 90 may drive the lifting motor 240 in the opposite direction according to a signal or a setting of the lifting input unit 400. As a result, the motor shaft 2500 may be rotated in the opposite direction and power may be transmitted to the gear module 260. When the fourth gear 2609 is rotated in the opposite direction, the fourth gear 2609 may be lifted along the lifting gear 2006.

When the guide rail protrusion 2604 is inserted into the second seating groove 2009, the guide rail protrusion 2604 may then exit from the second seating groove 2009 by the operation of the lifting motor 240. The guide rail protrusion may also be lifted along the guide rail 2008.

The guide rail protrusions 2604 may reach the first seating groove 2007 while being continuously lifted. The guide rail protrusion 2604 may be inserted into the first seating groove 2007. Accordingly, the lifting motor 240 may be temporarily subjected to a large load.

When the load is input, the controller 90 may determine that the lifting is completed and stop the driving of the lift motor 240. In other words, the second lifting cover 210 and the water outflow nozzle 240 may be lifted until the guide rail protrusion 2604 is inserted into the first seating groove 2007.

Figure 11:
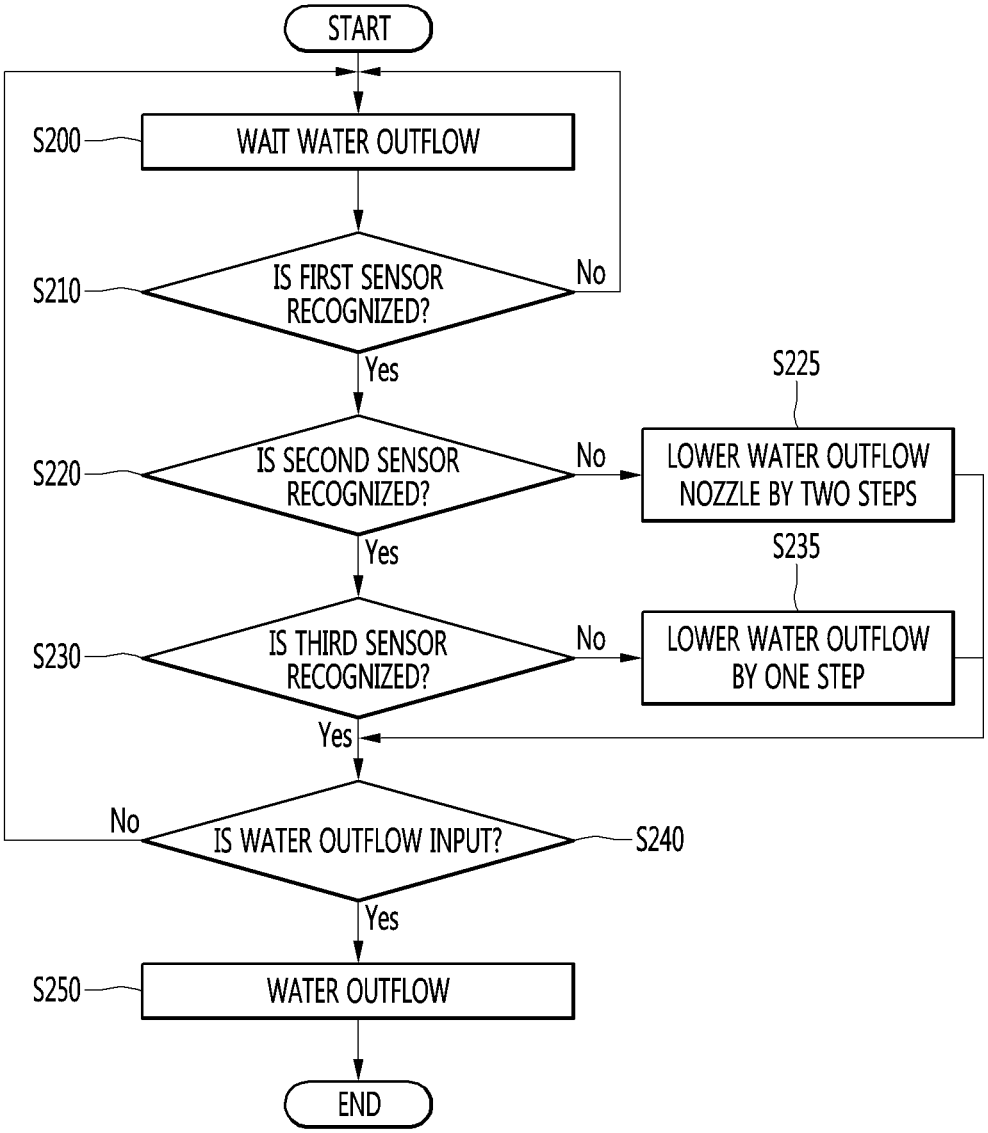
FIG. 11 illustrates a control flow of the water purifier according to the second embodiment.
Figure 12:
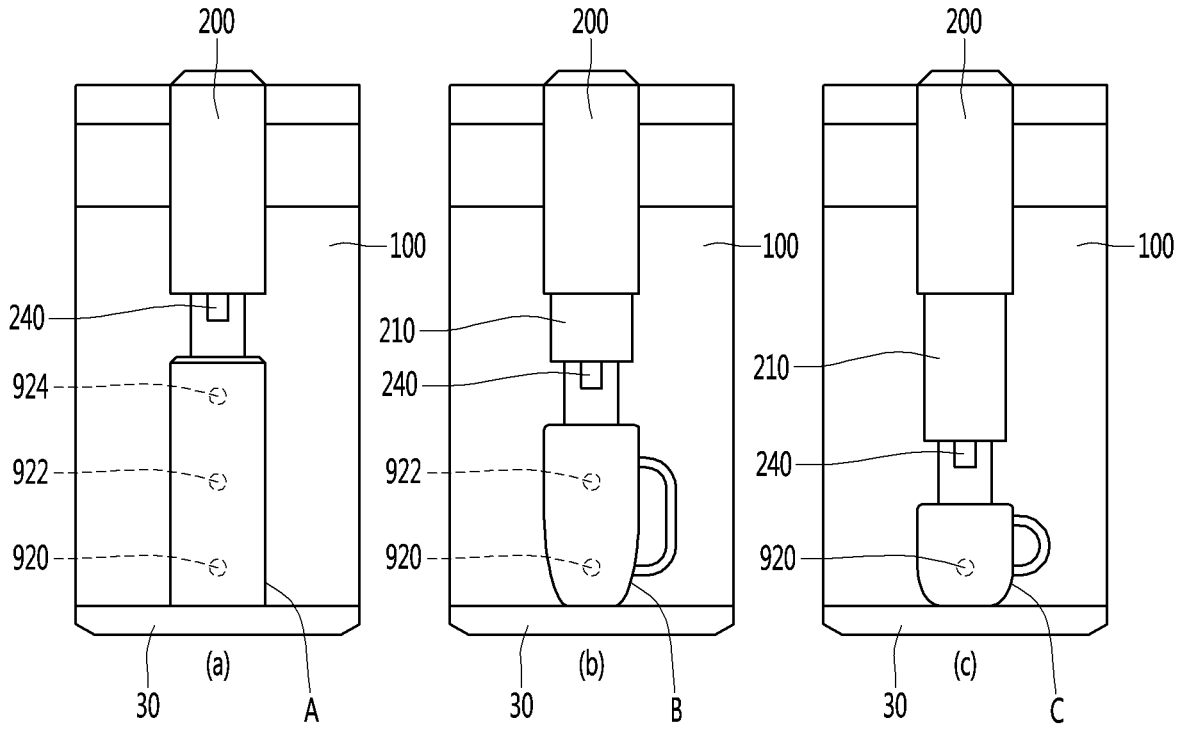
FIG. 12 is a diagram exemplarily illustrating the control of FIG. 11.

FIGS. 11 and 12 illustrate a flow in which the water purifier 1 is controlled according to information detected by the sensor 92. The sensing unit 92 may include a first sensor 920, a second sensor 922, and a third sensor 924 to detect the presence or absence of an object. The number of sensors is illustrative and may be provided in various numbers.

The first, second, and third sensors 920, 922, and 924 may be mounted on the front cover 100. Particularly, the first, second, and third sensors 920, 922, and 924 may be sequentially installed on the flat surface insert 1002 in a state of being spaced apart from each other in a vertical direction. The second sensor 922 may be located above the first sensor 920 and the third sensor 924 may be located above the second sensor 922. At this time, the position of each sensor may be determined according to the size of the water intake container.

The first sensor 920 may be located at a height which may be recognized in a case where the water intake container C having a low height is seated in the tray 30. In other words, the first sensor 920 may be a sensor which is installed on the lowermost side of a plurality of sensors spaced apart from each other in the vertical direction.

For example, as illustrated in FIG. 12 (*c*), in a case where a liquid intake container C having a low height such as a coffee cup is seated in the tray 30, the water intake container C may be recognized by the first sensor 920.

The third sensor 924 may be located at a height which may be recognized in a case where a water intake container A having a high height is seated on the tray 30. For example, as illustrated in FIG. 12 (*a*), in a case where the water intake container A having a high height such as a tumbler is seated on the tray 30, the water intake container A may be recognized by the first, second, and third sensors 920, 922, 924.

The second sensor 922 may be located at the center portion of the first sensor 920 and the third sensor 924. Therefore, it may be recognized in a case where a water intake container B having a middle height is seated on the tray 30. For example, as illustrated in FIG. 12 (*b*), in a case where the water intake container B having a middle height such as a mug is seated on the tray 30, the water intake container B may be recognized by the first and second sensors 920 and 922.

Referring to FIG. 9 and FIG. 12, when explaining FIG. 11, the water purifier 1 may be in a water outflow waiting state (S200). Then, it is determined whether or not the first sensor 920 recognizes a container (S210). As illustrated in FIG. 12, even in a case where the water intake containers A, B, and C having a certain height are seated on the tray 30, the water intake containers A, B, and C may be recognized by the first sensor 920.

Whether or not the first sensor 920 is recognized may be understood by determining whether or not the water intake container is seated on the tray 30. In a case where the first sensor 920 does not recognize a container, the water purifier may be continuously provided in a water outflow waiting state.

When the first sensor 920 recognizes a container, it may be determined that a liquid intake container is seated in the tray 30. Then, it may be determined whether or not the second sensor 220 is activated (S220). When the second sensor 220 is activated, it may be determined whether or not the third sensor 220 is activated (S230).

When the first sensor 920 is activated but the second sensor 220 is not activated, it may be determined as a state such as in FIG. 12 (*c*). In other words, it may be determined that the liquid intake container C having a low height is seated and the lowering of the water outflow nozzle 240 is required. Accordingly, the water outflow nozzle 240 may be lowered by two steps (S225).

In other words, when only a sensor which is located at the lowermost side of a plurality of sensors spaced in the vertical direction is recognized, the water outflow nozzle may be lowered by two steps. Thus, the water outflow nozzle 240 may be lowered to the maximum.

When the first and second sensors 920 and 922 are activated but the third sensor 924 is not activated, it may be determined as a state such as in FIG. 12 (*b*). In other words, it may be determined that the water intake container B having the middle height is seated and the lowering of the water outflow nozzle 240 may be required. Accordingly, the water outflow nozzle 240 may be lowered by one step (S235).

This corresponds to a case where a sensor located at the lowermost side of the plurality of sensors and a sensor located at the upper portion of the sensors are recognized. In this case, the water outflow nozzle 240 may be lowered to a range smaller than the maximum.

The lowering of the water outflow nozzle 240 by two steps may equate to a state where the second lifting cover 210 is lowered to the maximum. The lowering of the water outflow nozzle 240 by one step may equate to a state of being lowered to a middle degree as compared with the lowering by two steps.

For example, a third seating groove may be formed at a middle portion between the first seating groove 2007 and the second seating groove 2009. The lowering of the water outflow nozzle 240 by one step may correspond to a lowering until the guide rail protrusion 2604 is seated in the third seating groove. The lowering of the water outflow nozzle 240 by two steps may correspond to a lowering until the guide rail protrusion 2604 is seated in the second seating groove 2009.

In a case where the first, second, and third sensors 920, 922, and 924 are activated, it may be determined as a state such as in FIG. 12 (*a*). In other words, it may be determined that the liquid intake container A having a high height is seated, and it may be recognized that the lowering of the water outflow nozzle 240 is not required.

The water outflow nozzle 240 may be lifted and lowered step by step according to the height of the water intake container detected by the plurality of sensors. The water outflow nozzle 240 may be lifted and lowered in a plurality of steps according to the number of the plurality of sensors. Therefore, the water outflow nozzle 240 may correspond to the height of the water intake container more variously.

If the lowering of the water outflow nozzle 240 is completed or it is recognized that lowering is not required, it may be determined whether or not water outflow is performed (S240). It may be possible to determine whether or not there is an input to the water outflow input unit 410 by the water outflow. When the water outflow input unit 410 is input, the water outflow valve 94 may be opened and water may be discharged to the water outflow nozzle 240.

The water outflow nozzle 240 may be returned to the original position thereof when there is no input to the water outflow input unit 410 for a predetermined time or when the water outflow is completed. In other words, the lifting motor 250 may be driven in the opposite direction so that the water outflow nozzle 240 may be lifted until the guide rail protrusion 2604 is seated in the first seating groove 2007.

The water outflow may be performed at a position adjacent to the water intake container by the lifting and lowering of such a water outflow nozzle 240. Accordingly, it may be possible to prevent the water discharged from being scattered. Particularly, when the water at a very high temperature is discharged, it may be possible to prevent the scattering of water, thereby assuring the safety of the user.

The water purifier according to an embodiment may include a case and a dispenser coupled to one side of the case. The dispenser may include a water outflow side cover seated in the case, a first lifting cover coupled to the water outflow side cover, a second lifting cover movably received in the inside of the first lifting cover, a lifting motor coupled to the second lifting cover, a gear module interlocked with the lifting motor, and a water outflow nozzle installed on the second lifting cover and through which water is discharged.

The first lifting cover may include a lifting gear extending in the vertical direction. The gear module may include a gear bracket coupled to the second lifting cover, and a gear rotatably installed in the gear bracket and engaged with the lifting gear. Accordingly, the gear may be rotated along the lifting gear by the operation of the lifting motor, and the second lifting cover may be relatively moved relative to the first lifting cover in a vertical direction.

According to an embodiment, there is provided a control method of a water purifier including: operating a lifting motor, in a case of determining that lowering of the water outflow nozzle is required or there is an input of the lifting input unit, by a water intake container being seated on a tray disposed below the water outflow nozzle in a vertical direction and recognizing a height of the water intake container. In addition, according to the operation of the lifting motor, the gear coupled to the second lifting cover may be rotated and is lowered along the lifting gear extending from the first lifting cover in the vertical direction, and thus the second lifting cover may be moved to lower part together with the water outflow nozzle.

In a case where there is an input to the water outflow input unit, water may be discharged from the water outflow nozzle and water is taken in the water intake container. The water purifier and the control method thereof according to the embodiment configured as described above has the following effects.

As the lifting motor is driven and the lifting cover installed in the water outflow nozzle is relatively moved in the vertical direction, the user's convenience may be enhanced and stability may be ensured. Particularly, as the water outflow nozzle is lowered by recognizing the simple operation of depressing a button of the lifting input unit or the water intake container by the user, the convenience of the user may be further increased.

Water scattering may be prevented as the water outflow nozzle is lowered corresponding to the height of a water intake container. In addition, in a case where hot water with a high temperature is taken, the safety of the user may be assured. In addition, the water outflow nozzle may be rotatably provided in a horizontal direction, and thus the user may freely move the water outflow nozzle as needed.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid dispenser comprising:

a case; and a dispenser coupled to the case, wherein the dispenser includes:

a dispenser side cover coupled to the case;

a stationary cover coupled to the dispenser side cover;

an adjustable cover configured to be movable within the stationary cover;

a lifting motor coupled to the adjustable cover, a gear module operably coupled to the lifting motor; and a dispenser nozzle installed in the adjustable cover and configured to discharge liquid, wherein the stationary cover includes a rack gear that extends in a vertical direction, wherein the gear module includes:

a gear bracket attached to the adjustable cover; and a gear installed at the gear bracket and interconnected with the rack gear; and wherein in response to the gear being rotated along the rack gear by an operation of the lifting motor, the adjustable cover is moved with respect to the stationary cover in the vertical direction.

2. The liquid dispenser of claim 1, wherein the lifting motor includes a motor shaft and a motor gear connected to the motor shaft, and wherein the gear module includes:

a first gear engaged with the motor gear;

a second gear provided coaxially with the first gear;

a third gear engaged with the second gear; and a fourth gear provided coaxially with the third gear and engaged with the rack gear.

3. The liquid dispenser of claim 1, wherein the dispenser side cover is configured to be rotatable with respect to the case in a horizontal direction, and wherein, as the dispenser side cover is rotated, the stationary and adjustable covers and the dispenser nozzle are rotated.

4. The liquid dispenser of claim 3, further comprising a tray rotatably coupled to a base cover that forms a bottom surface of the case, wherein a rotation position of the tray corresponds to a rotation position of the dispenser side cover so as to be positioned below the dispenser nozzle in the vertical direction.

5. The liquid dispenser of claim 1, wherein the dispenser further includes a dispenser top cover that extends from a top cover that forms an upper surface of the case and covers the stationary cover, and wherein the dispenser top cover includes an input for inputting a predetermined command.

6. The liquid dispenser of claim 5, wherein the input includes a lifting input, and wherein the liquid dispenser further comprises a controller configured to lift and lower the dispenser nozzle by operating the lifting motor according to an input signal to the lifting input.

7. The liquid dispenser of claim 1, wherein the case includes:

a base cover that forms a bottom surface of the case; and a front cover that forms a front surface of the case, and through which the dispenser protrudes and to which the dispenser is coupled, the liquid dispenser further comprising:

a tray coupled to the base cover to protrude forward; and a plurality of sensors spaced apart from each other in the front cover in the vertical direction and configured to detect a height of a container seated on the tray.

8. The liquid dispenser of claim 7, further comprising:

a controller configured to operate the driving motor to lift and lower the dispenser nozzle according to the height of the container detected by the plurality of sensors.

9. The liquid dispenser of claim 1, wherein the stationary cover further includes a guide rail which is spaced apart from the rack gear, which extends in the vertical direction, and which includes a plurality of seating grooves spaced in the vertical direction along a first side of the guide rail, and wherein the gear bracket includes a guide rail protrusion which is in contact with the guide rail, and which is configured to be inserted into one of the plurality of seating grooves depending on a position of the adjustable cover in the vertical direction.

10. The liquid dispenser of claim 9, wherein the stationary cover includes an outflow opening provided between the rack gear and the guide rail, and wherein the liquid dispenser further comprises:

a dispenser pipe that extends from an inner portion of the case through the outflow opening and is connected to the dispenser nozzle.

11. The liquid dispenser of claim 9, wherein the plurality of seating grooves includes a first seating groove and a second seating groove formed below the first seating groove, and wherein when the adjustable cover is in a first position, the guide rail protrusion is inserted into the first seating groove, and when the adjustable cover is in a second position, the guide rail protrusion is inserted into the second seating groove.

12. The liquid dispenser of claim 11, wherein the stationary cover includes:

a first plate on which the rack gear and the guide rail are formed; and a second plate attached to the first plate and configured to form an inner space with the first plate, wherein a first surface of the first plate is coupled to the dispenser side cover, and wherein the rack gear and the guide rail protrude from a second surface of the first plate opposite the first surface and extend in the vertical direction.

13. The liquid dispenser of claim 12, wherein the second plate includes a pair of guide protrusions that protrude toward the inner space from a first surface of the second plate and are located adjacent to the rack gear and the guide rail, respectively, and wherein the gear bracket includes a pair of gear guide protrusions that correspond to the pair of guide protrusions so as to be in contact with the pair of guide protrusions, respectively.

14. The liquid dispenser of claim 12, wherein the adjustable cover is received in the inner space formed by the first plate and the second plate of the stationary cover, and wherein the adjustable cover includes a first plate and a second plate that form a shape corresponding to the first plate and the second plate of the stationary cover.

15. The liquid dispenser of claim 14, wherein the second plate of the adjustable cover includes a pair of grips, and wherein the second plate of the stationary cover includes cut out portions configured to expose the pair of grips when the adjustable cover is in the first position.

16. A control method of a liquid dispenser which includes a stationary cover and an adjustable cover provided inside the stationary cover and in which a dispenser nozzle configured to dispense liquid is installed, the control method comprising:

detecting a height of a container placed on a tray through a plurality of sensors or receiving an external input through an input unit; and;

operating a lifting motor configured to rotate a gear coupled to the adjustable cover when the height of the container is less than a predetermined height or when the external input is a command for moving the adjustable cover, wherein the gear is configured to move down along a rack gear attached to the stationary cover in a vertical direction such that the adjustable cover and the dispenser nozzle move downward from a first position to a second position which is lower than the first position, and when a command for liquid outflow is input through a liquid outflow input unit, liquid outflows from the dispenser nozzle.

17. The control method of claim 16, wherein the stationary cover includes a guide rail which is spaced apart from the rack gear and extends in the vertical direction, the guide rail including a first seating groove and a second seating groove provided below the first seating groove, and wherein, when only a first sensor of the plurality of sensors is activated, the dispenser nozzle is moved downward from the first seating groove to the second seating groove.

18. The control method of claim 17, wherein the guide rail further includes a third seating groove provided between the first seating groove and the second seating groove, and wherein, when the first sensor and a second sensor provided above the first sensor of the plurality of sensors are activated, the dispenser nozzle is moved downward from the first seating groove to the third seating groove.

19. The control method of claim 16, wherein a first sensor of the plurality of sensors is installed at a lowermost position and is configured to detect whether the container is seated or not.

20. The control method of claim 19, wherein, when only the first sensor of the plurality of sensors is activated, the lifting motor is operated so that the dispenser nozzle is lowered to a maximum extension.

21. The control method of claim 20, wherein, when the first sensor and a second sensor which is arranged above the first sensor are activated, the lifting motor is operated so that the dispenser nozzle is lowered to an intermediate extension.

22. The control method of claim 16, wherein the lifting motor is operated in an opposite direction when the liquid outflow from the dispenser nozzle is completed and a predetermined time passes, or when there is an input received through the input unit to move up the adjustable cover from the second position, and wherein, according to the operation of the lifting motor in the opposite direction, the gear is configured to rotate in the opposite direction to move up along the rack gear in order to lift up the adjustable and the dispenser nozzle.

23. The control method of claim 22, wherein the stationary cover includes a guide rail that extends in a vertical direction, the guide rail having a first seating groove and a second seating groove spaced apart from the first seating groove in the vertical direction, and wherein the dispenser nozzle is moved in the vertical direction by a separation distance between the first seating groove and the second seating groove.

24. The control method of claim 23, further comprising:

a gear bracket configured to slide along the guide rail, the gear bracket including a guide rail protrusion configured to be inserted into the first and second seating grooves, and further including the gear, wherein the lifting motor is operated until the guide rail protrusion moves from one of the first seating groove or the second seating groove to another one of the first seating groove or the second seating groove.

25. The control method of claim 24, wherein the gear bracket and the lifting motor are coupled to the adjustable cover to be lifted and lowered together with the adjustable cover.

* * * * *